United States Patent [19]

Kawaguchi et al.

[11] Patent Number: 4,961,403

[45] Date of Patent: Oct. 9, 1990

[54] ENGINE GENERATOR SET FOR A VEHICLE

[75] Inventors: Toru Kawaguchi; Masaaki Endo, both of Saitama, Japan

[73] Assignee: Honda Giken Kogyo Kabushiki Kaisha, Tokyo, Japan

[21] Appl. No.: 435,779

[22] Filed: Nov. 13, 1989

[30] Foreign Application Priority Data

Nov. 15, 1988 [JP] Japan ..... 63-288067

[51] Int. Cl.[5] ..... F02B 43/08

[52] U.S. Cl. ..... 123/2; 290/1 A; 248/638; 180/296

[58] Field of Search ..... 123/2, 195 R, 195 C, 123/198 R, 198 E; 290/1 A, 1 B; 181/204; 248/562, 638; 180/296, 299, 309, 89.2

[56] References Cited

U.S. PATENT DOCUMENTS 3,378,094 4/1968 Myers ..... 180/291
4,540,888 9/1985 Drewry et al. ..... 290/1 R
4,548,164 10/1985 Ylönen et al. ..... 123/2
4,629,031 12/1986 Kato et al. ..... 181/204
4,698,975 10/1987 Tsukamoto et al. ..... 123/2

FOREIGN PATENT DOCUMENTS 63-36622 3/1988 Japan .

*Primary Examiner*—Noah P. Kamen
*Attorney, Agent, or Firm*—Irving M. Weiner; Joseph P. Carrier; Pamela S. Burt

[57] ABSTRACT

An engine generator set includes a frame mountable to the underside of a vehicle floor or chassis. An engine and a generator are both resiliently mounted to the frame by way of shock mounts and enclosed by a cover. The engine has an exhaust pipe extending downwardly through an opening in the bottom of the cover. A muffler mount is secured to the frame and has elastomeric joints. A muffler is resiliently mounted to the muffler mount by the elastomeric joints and is connected to the exhaust pipe through a flexible pipe. This arrangement serves to reduce the engine and generator vibration that is transmitted to the muffler.

7 Claims, 5 Drawing Sheets

ENGINE GENERATOR SET FOR A VEHICLE

BACKGROUND OF THE INVENTION

1. Field of the Invention

The present invention relates to engine generator sets for installation, especially for installation in large vehicles such as a recreational vehicle and the like.

2. Description of the Relevant Art

Usually, recreational vehicles, such as a travel trailer and a touring bus, carry many amenities of home living including electric lights, an air conditioning system and other electric appliances. The power necessary to run these electric appliances is typically derived from an engine generator set. Such engine generator set is particularly preferable when the appliance power load of the recreational vehicle is heavy.

U.S. Pat. No. 4,540,888, issued to Drewry et al., discloses an engine generator set wherein an engine includes a drive shaft which extends vertically downwardly through a mounting tray for mating with a shaft of a generator. The generator is positioned directly below the engine so as to extend beneath the vehicle. An exhaust pipe is connected at one end to the engine and extends through an opening in the mounting tray so that its opposite end is connected to a muffler.

U.S. Pat. No. 4,629,031, issued to Kato et al., discloses an engine-operated generator wherein an engine and a generator are arranged side by side within a container. An exhaust pipe has one end connected to the engine and the other end connected to a muffler which extends horizontally below the container.

A common disadvantage of the prior art engine generator sets is that the engine and generator vibration is directly transmitted to the muffler. This causes considerable noise due to ,resonance of the muffler. Also, since the mufflers of these known sets extend below the vehicle frames, the prior art arrangements can hardly be installed in a vehicle a rather limited a space below the frame or floor of the vehicle is rather limited.

SUMMARY OF THE INVENTION

It is, therefore, an object of the invention to provide an engine generator set which is quiet and which is mountable without altering the design of a vehicle.

In accordance with the present invention, there is provided an engine generator set designed for installation in a relatively large vehicle such as a touring bus, and including a frame within which an engine and a generator are closely juxtaposed to each other. The frame is designed to depend from the vehicle floor, but may be mounted to a vehicle chassis. A cover surrounds the engine/generator unit. The engine is water cooled and has a drive shaft or crankshaft. The generator is located forwardly of the engine, when mounted in a vehicle, and has a generator shaft connected to the crankshaft of the engine and driven thereby. A plurality of shock mounts or vibration isolators are used to resiliently mount the engine and the generator to the frame. This resilient mounting of the engine and the generator to the frame serves to reduce the engine and generator vibration.

An engine cover surrounds the engine and includes a duct within which an exhaust pipe extends. The exhaust pipe has one end connected to the engine to receive exhaust gases and extends generally downwardly through an opening in the bottom of the cover. A cooling fan is situated adjacent to the engine and is equipped with a shroud which is connected for communication with the interior of the engine cover. The fan sucks air through an opening in the shroud, and the air flows through the duct so as to cool the exhaust pipe.

A muffler mount includes a horizontal frame of a generally rectangular shape which is secured to the underside of the frame of the engine/generator unit and extends sidewardly or rearwardly from the container. Mounted in a laterally spaced relation on the rear portion of the rectangular frame are a pair of upright frames of an inverted U-shape through which a muffler extends in a direction substantially at right angles to the direction in which the vehicle advances. The muffler is supported in cantilever fashion by the muffler mount and is disposed externally of and in a side-by-side relation to the engine cover. This arrangement serves to reduce the vertical dimension of the engine generator set. Therefore, the present set can be mounted in a vehicle having a relatively small space below the vehicle chassis or floor, without altering the design of the vehicle.

The muffler is connected to the other end of the exhaust pipe by way of a flexible pipe or joint. This flexible pipe serves to prevent transmission of the engine and generator vibration to the muffler. A plurality of elastomeric joints are used, so that the muffler is resiliently mounted by the muffler mount. The exhaust pipe, after passing through the bottom of the cover, extends horizontally rearwardly along the inner side of the rectangular frame for protection purposes.

BRIEF DESCRIPTION OF THE DRAWINGS

A better understanding of the invention may be had by reference to the following description when taken in conjunction with the accompanying drawings, in which.

DESCRIPTION OF THE PREFERRED EMBODIMENT

The illustrated embodiment is not intended to be exhaustive or to limit the invention to the precise form disclosed. It is chosen and described in order to best explain the principles of the invention and its application and practical use to enable those skilled in the art to best utilize the invention.

Figure 1:
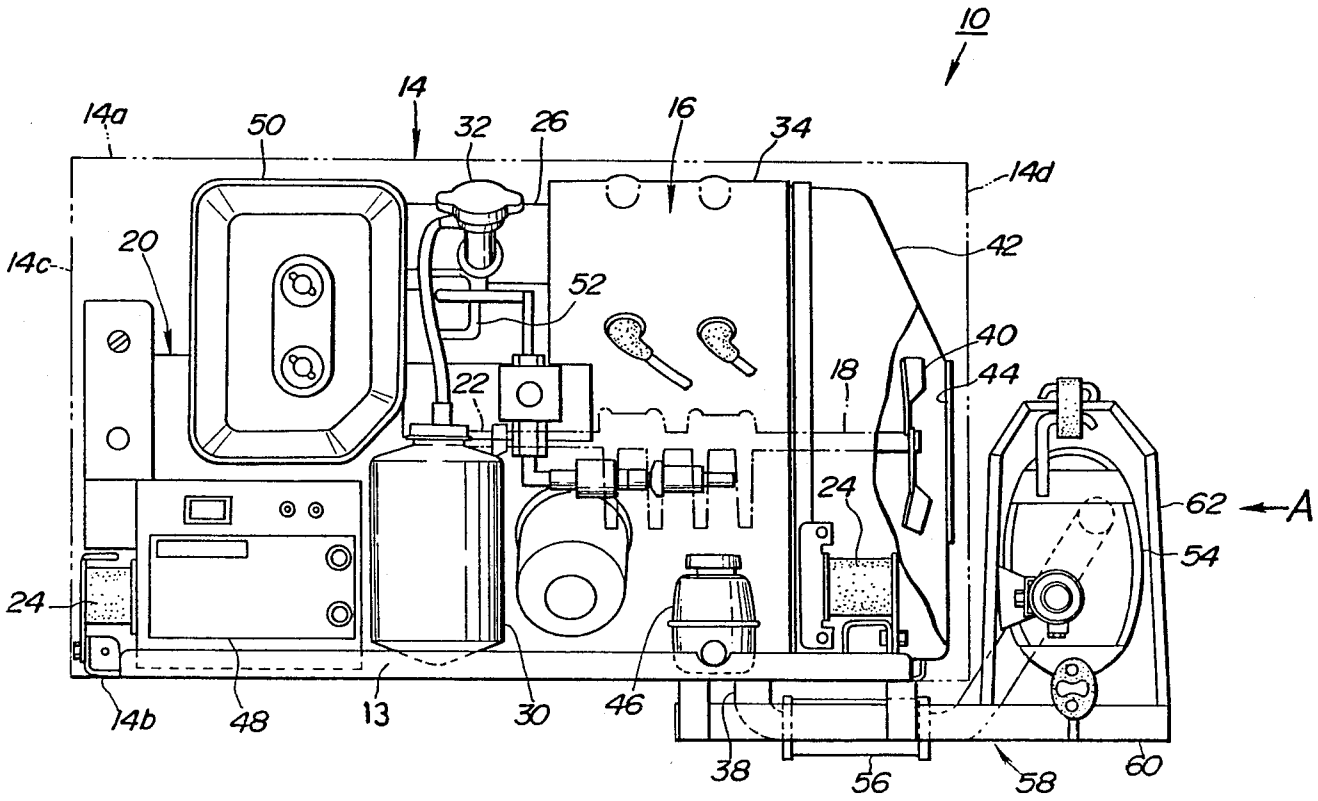
FIG. 1 is a side elevational view of an engine generator set according to the teachings of the present invention.
Figure 2:
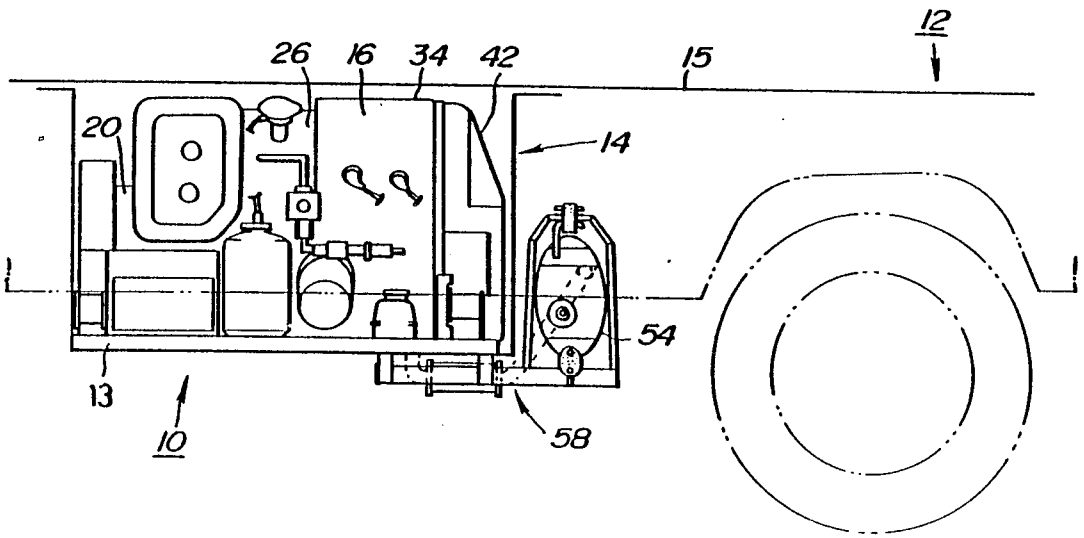
FIG. 2 is a schematic view showing the manner in which the engine generator set of FIG. 1 is installed in a recreational vehicle.
Figure 3:
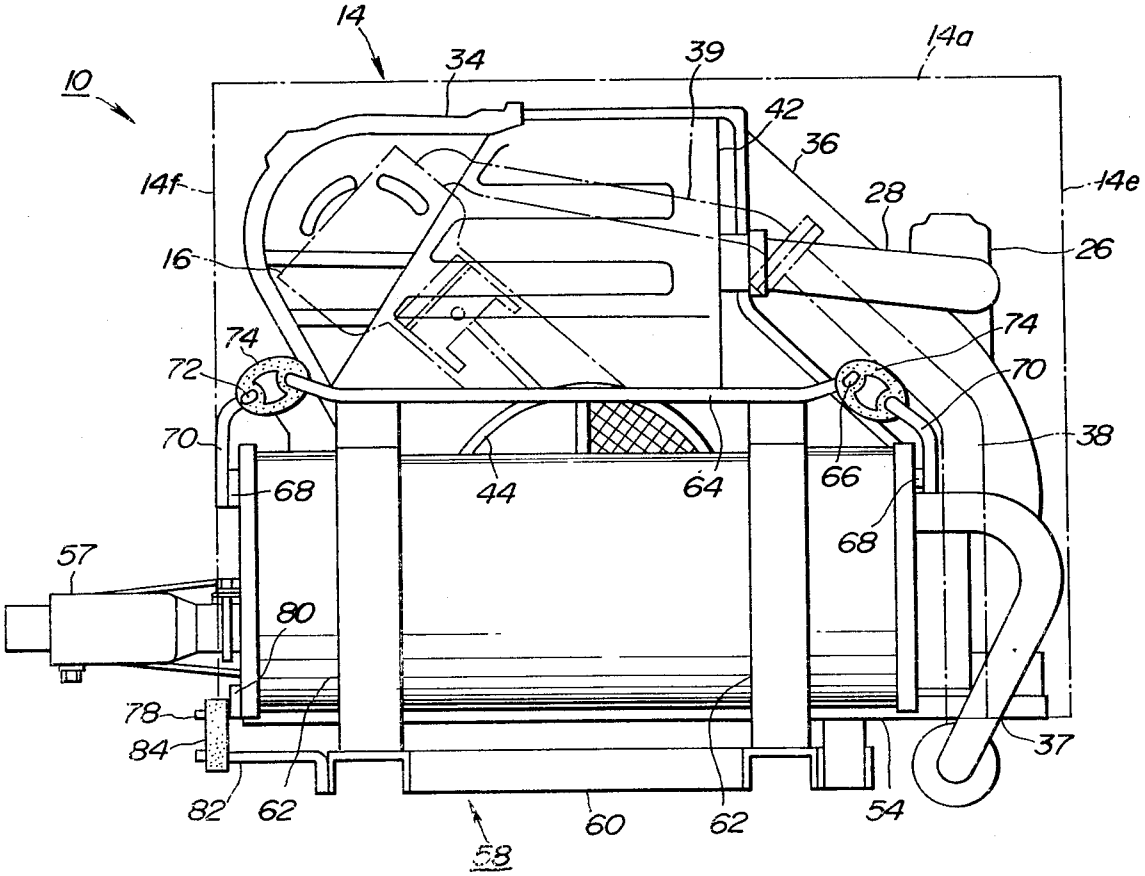
FIG. 3 is an enlarged view of the engine generator set as seen in the direction of arrow a in FIG. 1.

With reference to FIGS. 1, 2 and 3 there is shown an engine generator set as generally indicated at 10 and installed in a recreational vehicle 12 such as a touring bus. The engine generator set 10 includes a frame 13 surrounded by a cover 14 and depending from a floor or a chassis 15 of the vehicle 12. Illustratively, the cover 14 has a top wall 14*a*, a bottom wall 14*b*, a front wall 14*c*, a rear wall 14*d*, a right wall 14*e*, and a left wall 14*f*. The left wall 14*f* of the container 14 preferably includes an opening (not shown) through which outside air may be introduced into the interior of the container 14. Mounted to the frame 13 is an internal combustion engine 16 which is water cooled and has a horizontally extending crankshaft 18. A generator 20 is located forwardly of the engine 16 and includes a shaft 22 which is connected to the engine crankshaft 18 so that power is transmitted from the engine crankshaft 18 to the generator shaft 22. A plurality of shock mounts or vibration isolators 24 are utilized to resiliently mount the engine/-generator set to the frame 13 for reducing transmission of the engine and generator vibrations to the frame.

At one side of the generator 20, there is provided a radiator 26 which conveys a coolant to the engine 16 through a suitable hose (now shown). The coolant circulates inside the engine 16 as a heat transfer medium. It picks up heat and gets hot, then flows back, through a rubber hose 28, to the radiator 26 where heat will transfer from the coolant to air. A fan (not shown) is arranged between the generator 20 and the radiator 26 to pull air through the radiator 26 to improve engine cooling. A reservior tank 30 is situated at the other side of the generator 20 to provide a reserve supply of coolant. Additional amounts of coolant may be supplied into the radiator 26 through a radiator cap 32 on the top of the radiator 26.

Referring to FIG. 3, an engine cover 34 surrounds the engine 16 and includes a duct 36 which extends generally downwardly from the upper portion thereof for communication with an opening 37 in the bottom wall **14*b* of the cover 14 and encloses an exhaust pipe 38. The exhaust pipe 38 has an upstream end connected to the engine 16 through exhaust manifolds 39 so as to receive exhaust gases of the engine. A cooling fan 40 (FIG. 1) is located behind the engine 16 (when mounted in the vehicle) closely to the rear wall 14*d* of the cover 14 and is driven by the engine crankshaft 18. The cooling fan 40 is equipped with a shroud 42 which is secured for communication with the interior of the engine cover 34. Air, sucked by the fan 40 through an opening 44 in the shroud 42, flows through the duct 36 to cool the exhaust pipe 38 as well as the engine 16 and flows out of the cover 14 through the bottom opening 37**.

With reference again to FIG. 1, an oil sump 46 is situated at one side of the engine 16 adjacent to the left wall **14*f* of the cover 14 to maintain a reservoir of oil for the engine 16. Also, at the same side of the engine 16, there is provided a control unit 48 for the operation of various components in the engine generator set 10. An air filter 50 is located above the control unit 48 and connected to a carburator 52 where air passing through the air filter 50 is mixed with fuel or gasoline to supply the engine 16** with a combustible air-fuel mixture.

Figure 4:
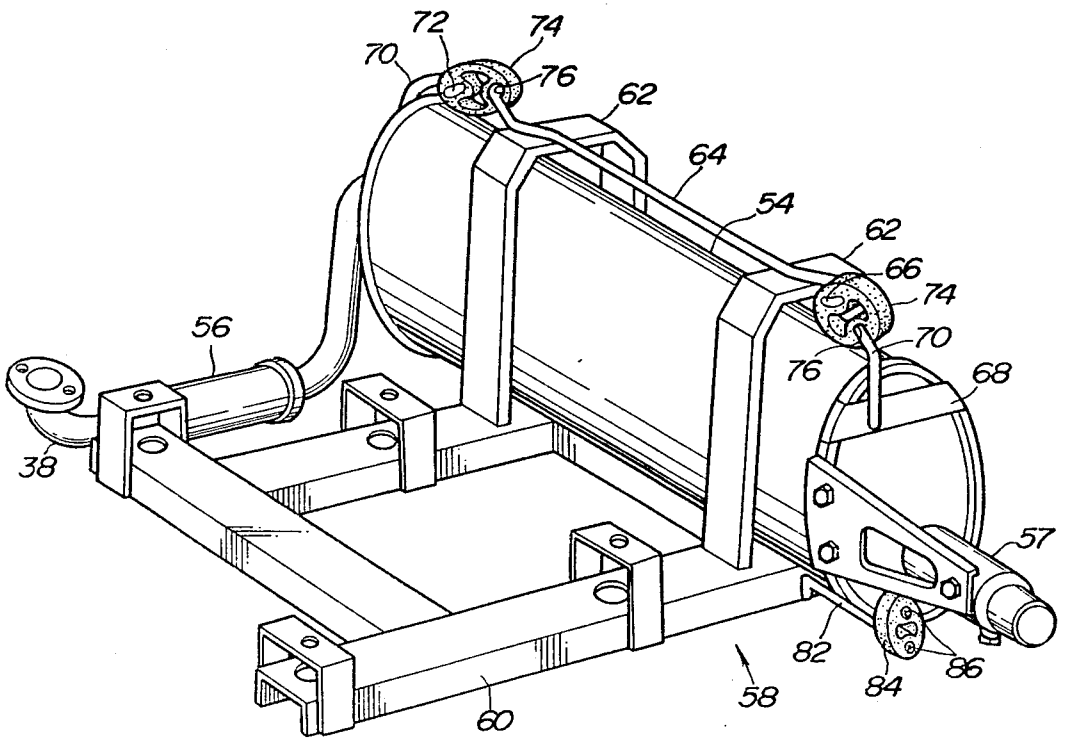
FIG. 4 is an enlarged perspective view of a muffler which forms part of the present invention.
Figure 5:
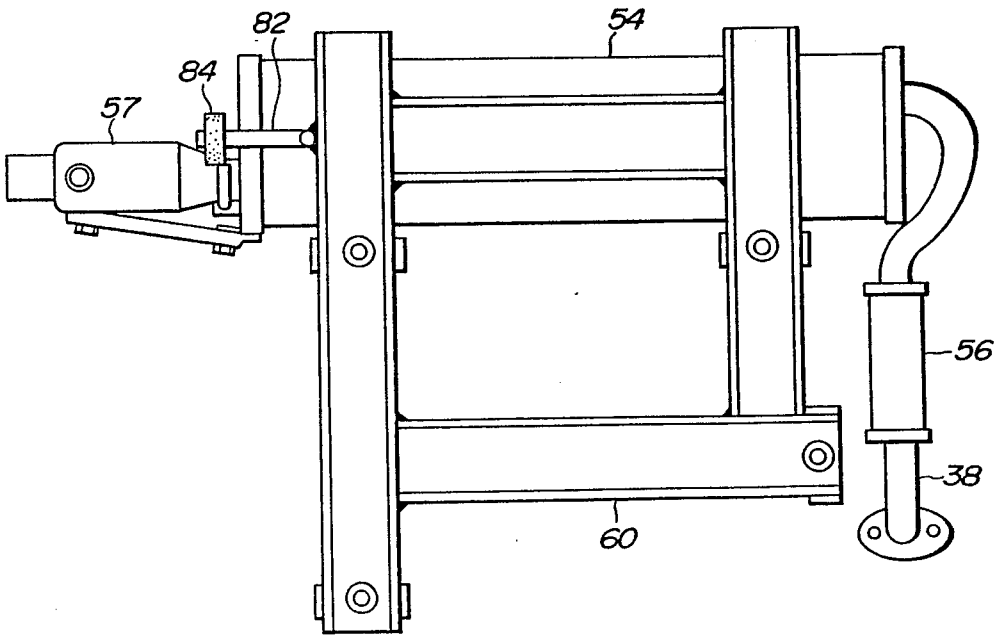
FIG. 5 is an enlarged bottom view of the muffler shown in FIG. 4.

A muffler 54 is of a generally cylindrical shape as best seen in FIG. 4 and is connected to a downstream end of the exhaust pipe 38 by way of a flexible pipe 56. The flexible pipe 56 is preferably made of stainless steel and is intended to absorb vibrations or prevent the engine and generator vibration from being transmitted to the muffler 54. The muffler 54, when mounted in the vehicle 12, is located rearwardly of the engine 16 and the generator 20 and extends in a direction substantially at right angles to the direction in which the vehicle advances The muffler 54 has a spark arrestor 57 at its downstream end.

A muffler mount, as generally indicated at 58, is secured to the cover 14 and intended to resiliently mount the muffler 54. More specifically, this mount 58 includes a horizontal frame 60 of a generally rectangular shape, bolted or otherwise secured to the underside of the cover 14 and extending sidewardly or rearwardly of the cover 14. Fixedly mounted in a laterally spaced relation on the rear portion of the rectangular frame 60 are a pair of upright frames 62, 62 of an inverted U-shape through which the muffler 54 extends. A laterally extending elongated support 64 in the form of a rod is secured to the top of the upright frames 62, 62 and has opposite ends bent to form hooks 66, 66. A plate-like member 68 is attached to each end of the muffler 54 and has a short rod 70 extending generally vertically upwardly therefrom. The free end of the short rod 70 is bent to form a hook 72. An elastomeric joint 74, made of synthetic rubber, is utilized to connect each short rod 70 to the elongated support 64. More specifically, each elastomeric joint 74 is of an elliptical shape and has a pair of through holes 76, 76 with which the hook 66 of the elongated support 64 and the hook 72 of the short rod 70 are both engaged. As best seen in FIG. 3, a pin 78 extends laterally outwardly from a plate-like member 80 which is, in turn, attached to one end of the muffler 54 opposite to an end to which the exhaust pipe 38 is connected. Also, a support rod 82 extends laterally outwardly from one side of the rectangular frame 60 below and parallel to the pin 78. An elastomeric joint 84, similar in construction to the elastomeric joint 74, has a pair of through holes 86 to, receive the free ends of the pin 78 and the support rod 82. In this way, the muffler 54 is resiliently supported by the muffler mount 58, so that the engine and generator vibration is not transmitted to the muffler 54. The exhaust pipe 38 extends along one side of the muffler mount 58.

While only certain preferred features of the present invention have been shown by way of illustration, many changes and modifications may be made to the invention as understood by those skilled in the art. It should be, therefore, understood that claims are intended to cover all such changes and modifications as fall within the spirit and scope of the invention.

What is claimed is:

1. An engine generator set comprising:

a frame adapted to be mounted to a vehicle and having first vibration isolator means;

an engine/generator unit including an engine having an exhaust pipe and a generator driven by said engine, said unit being resiliently mounted to said frame by said first vibration isolator means;

a cover for surrounding said engine/generator unit and having an opening through which said exhaust pipe extends;

a muffler mount secured to said frame and having second vibration isolator means;

a muffler resiliently mounted to said muffler mount by said second vibration isolator means, said muffler being located externally of and in a side-by-side relation to said cover; and a flexible pipe for connecting said exhaust pipe to said muffler.

2. An engine generator set according to claim 1, wherein said frame is adapted to depend from an underside of a floor of the vehicle.

3. An engine generator set according to claim 2, wherein said muffler mount includes a horizontal frame mounted to an underside of the cover and extends rearwardly therefrom, and a pair of inverted U-shaped frames mounted on said horizontal frame in a laterally spaced relation, said muffler extends through said pair of upright frames.

4. An engine generator set according to claim 3, wherein said muffler is located rearwardly of said engine and said generator, said muffler extends in a direction substantially at right angles to the direction in which the vehicle advances.

5. An engine generator set for a vehicle, comprising in combination:

a frame adapted to be mountable to an underside of a vehicle chassis;

an engine resiliently mounted to said frame and having an exhaust pipe;

a generator resiliently mounted to said frame and driven by said engine;

a cover for surrounding said frame to enclose said engine and said generator and having an opening through which said exhaust pipe extends;

a muffler, a muffler mount secured to said frame and having means for resiliently mounting said muffler thereto; and a flexible pipe for connecting said exhaust pipe to said muffler.

6. An engine generator set according to claim 5, wherein said muffler mount extends below and rearwardly of said cover, and said exhaust pipe extends inwardly of said muffler mount relative to the vehicle.

7. An engine generator set according to claim 5, wherein aid flexible pipe is made of stainless steel.

* * * * *

UNITED STATES PATENT AND TRADEMARK OFFICE

CERTIFICATE OF CORRECTION

PATENT NO. : 4,961,403

DATED : OCTOBER 9, 1990

INVENTOR(S) : KAWAGUCHI ET AL.

It is certified that error appears in the above-identified patent and that said Letters Patent is hereby corrected as shown below:

Column 1, line 36, change ",resonance" to --resonance--;
line 39, after "vehicle" insert --having--;
line 39, delete "a" (third occurrence);
line 40, change "of the vehicle is rather limited" to --thereof--.

Column 2, line 8, change "container" to --cover surrounding the engine/generator unit--.

Column 3, line 14, change "(now" to --(not--;
line 21, correct the spelling of "reservoir";
line 62 and 63, after "ad-vances" add a period.

Column 4, line 27, after "to" delete the comma.

Column 6, line 15 (Claim 7, line 2), change "aid" to --said--.

Signed and Sealed this

Fifth Day of March, 1991

*Attest:*

HARRY F. MANBECK, JR.

*Attesting Officer*

*Commissioner of Patents and Trademarks*